US006398390B1

(12) United States Patent
Schacht

(10) Patent No.: US 6,398,390 B1
(45) Date of Patent: Jun. 4, 2002

(54) DECORATIVE LAMPSHADE AND A METHOD OF MAKING THE SAME

(76) Inventor: Stephen T. Schacht, 2617 Victor Street, Victoria, British Columbia (CA), V8R 4E3

( * ) Notice: Subject to any disclaimer, the term of this patent is extended or adjusted under 35 U.S.C. 154(b) by 46 days.

(21) Appl. No.: 09/603,583

(22) Filed: Jun. 26, 2000

(51) Int. Cl.[7] ..... F21V 1/04
(52) U.S. Cl. ..... 362/356; 362/351; 362/360
(58) Field of Search ..... 362/351, 355, 362/356, 357, 358, 360, 361, 352

(56) References Cited

U.S. PATENT DOCUMENTS

| | | | | | |
|---|---|---|---|---|---|
| 1,992,777 | A | * | 2/1935 | Schwarz | 362/356 |
| 2,538,676 | A | * | 1/1951 | Enright | 362/358 |
| 2,884,515 | A | * | 4/1959 | Fogel | 362/358 |
| 3,582,643 | A | * | 6/1971 | Heise | 362/356 |
| 3,764,801 | A | | 10/1973 | Mainieks | |
| 4,068,120 | A | | 1/1978 | Throckmorton | |
| 4,117,533 | A | * | 9/1978 | Hagelthorn | 362/363 |
| 4,165,529 | A | * | 8/1979 | Hagelthorn | 362/358 |
| 4,268,896 | A | | 5/1981 | Mann | |
| 5,211,474 | A | | 5/1993 | Leitner | |
| 5,746,506 | A | | 5/1998 | Dunbar | |
| 6,000,817 | A | * | 12/1999 | Chan | 362/311 |

FOREIGN PATENT DOCUMENTS

| | | | | |
|---|---|---|---|---|
| GB | 20259 | * | 2/1936 | 362/360 |

* cited by examiner

*Primary Examiner*—Sandra O'Shea
*Assistant Examiner*—Peggy A Neils
(74) *Attorney, Agent, or Firm*—Robert H. Barrigar

(57) ABSTRACT

A novel lampshade, a kit for assembling lampshades, and a novel method of manufacturing lampshades are disclosed. The lampshade is composed of a plurality of semi-rigid or rigid elongate slotted bars, cords linking all the bars and resilient panels snugly fitting between the bars. The bars are arranged in a truncated conical, cylindrical, or possibly in pyramidal configuration, or can have rectangular horizontal cross-section. The bars are secured in specific positions on each cord by using adhesives or mechanical means such as crimped tubes. Resilient panels, typically of trapezoidal or rectangular shape, are inserted into the slots in the bars and fit tightly between the bars. The panels may be made of synthetic paper such as YUPO™ or of thin plastic sheets. By using such techniques as process color printing, manufacturers will have the possibility to develop many variations of panels with different colors, patterns or graphic designs that they consider to be suitable in order to make the finished lampshade attractive to a wide customer base. The structure of the lampshade, which can be manufactured in kit form for ease of shipping and readily assembled by the user, is very flexible, resilient, customizable, resistant to damage, and facile to maintain.

21 Claims, 4 Drawing Sheets

Figure 3
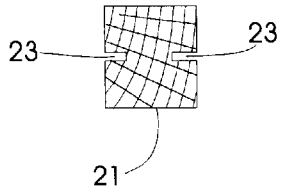
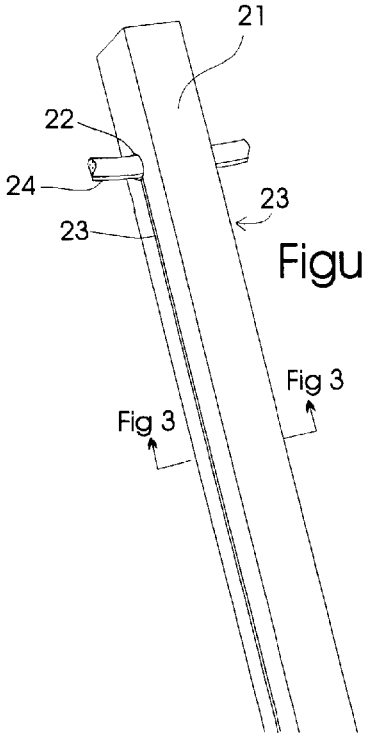
Figure 4
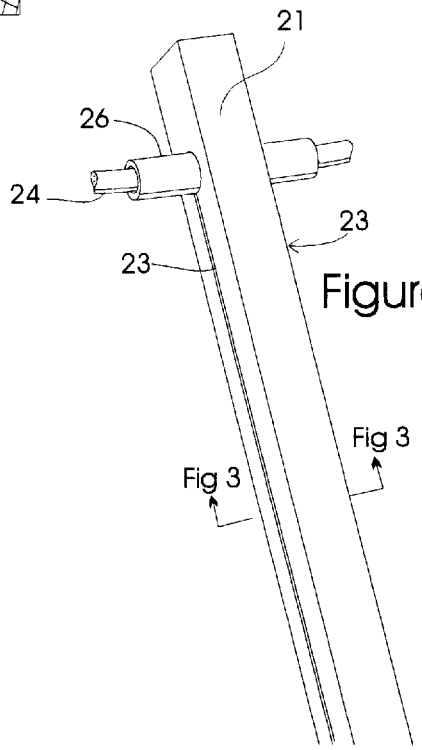
Figure 5
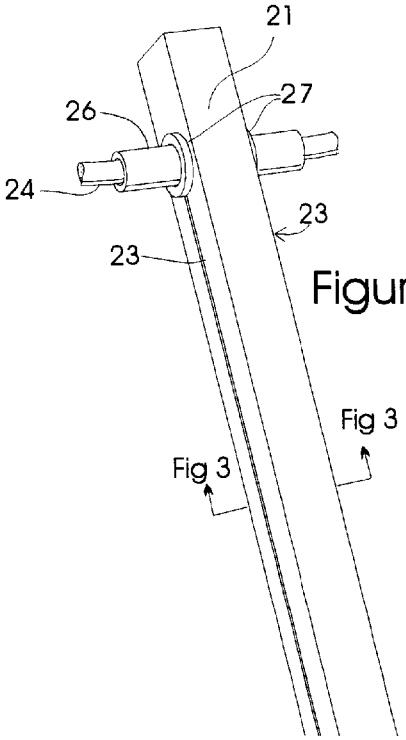
Figure 6
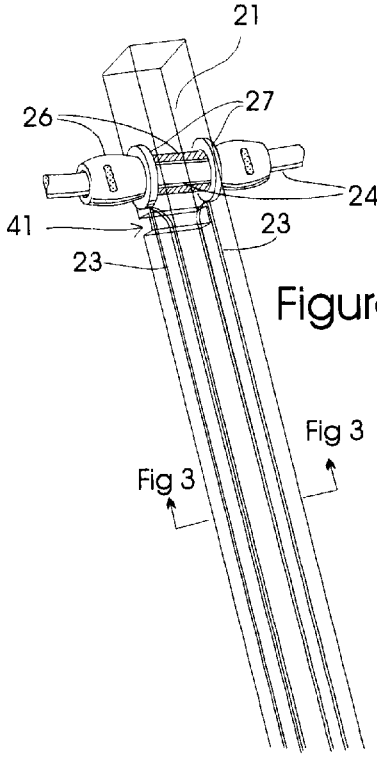
Figure 7

Figure 8
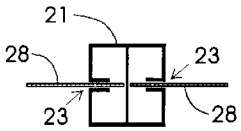
Figure 9
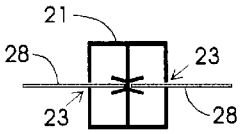
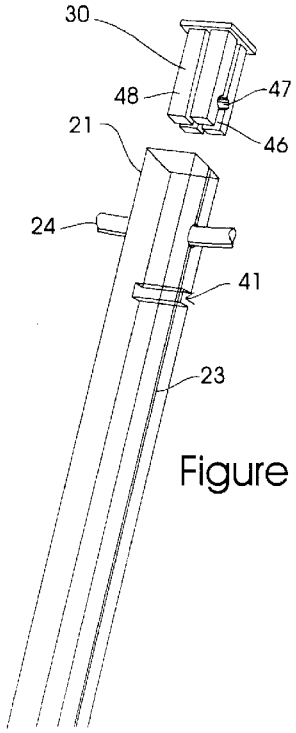
Figure 10
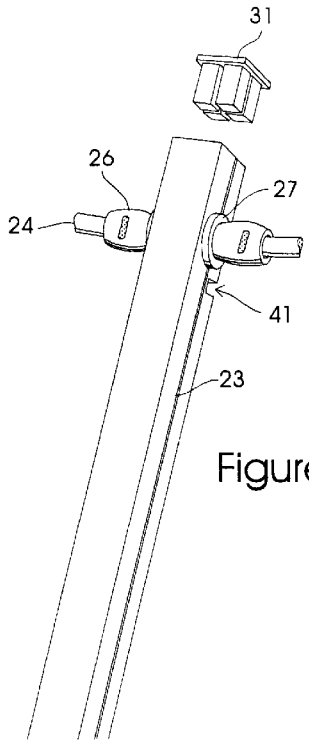
Figure 11
Figure 12
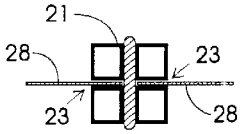
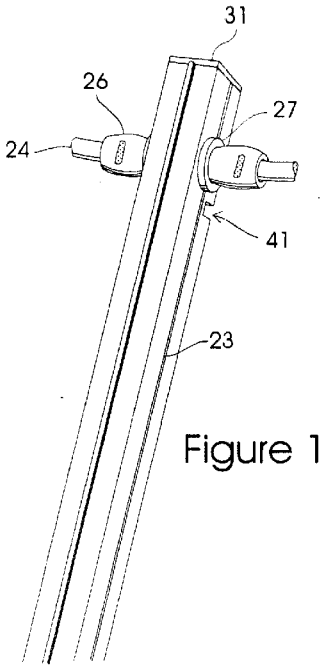
Figure 13
Figure 14
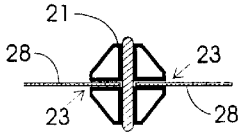
Figure 15
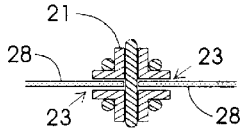

DECORATIVE LAMPSHADE AND A METHOD OF MAKING THE SAME

FIELD OF THE INVENTION

The present invention relates to lampshades, a kit for assembling lampshades, and a novel method of manufacturing lampshades. The completed lampshade is a flexible, resilient, customizable lampshade that consists in a preferred embodiment of a series of elongate slotted bars between which removable paper or plastic panels are positioned and inserted into opposed elongate slots of the bars. The bars are interconnected by cords, wires or the like in the vicinity of the two ends of the bars. The bars and panels can be assembled from a kit and arranged in a particular configuration (i.e., cylinder, cone, pyramid) preferably having circular symmetry.

BACKGROUND OF THE INVENTION

Lampshades are mounted on lamps to protect and decorate them, and to dim the direct light coming from the source of light that has over the centuries evolved from candle to bulb. There have been proposed numerous, more or less commonly adopted designs and methods for making lampshades. One traditional and very popular type of lampshade, known also as a "Tiffany" lampshade, consists of glass or mica panels joined by the lead came that have been in the recent past frequently replaced by adhesive foil and solder or adhesive modelling compounds that imitate the lead came construction. The method of fabricating this type of lampshade is very labour intensive and expensive. Although elegant, "Tiffany" lampshades are usually heavy, difficult to handle, susceptible to damage, and problematic to repair.

Methods for making and designing lampshades evolved over time. Probably the most common and the most inexpensive method of making lampshades today is a method that involves the use of a wire frame of a suitable shape onto which fabric or other material is stretched and fastened, either by sewing or by the use of adhesives. A typical frame for such lampshades has a top and bottom ring or band, interconnected by vertically oriented strut members. While this method of making lampshades is useful and very simple, it produces finished lampshades that require a shipping carton as large as the finished product. Further, such lampshades have an unalterable appearance. Lampshades manufactured in accordance with this particular method have in addition the disadvantage of being easily damaged, difficult to repair, and difficult to clean.

There have been many attempts to design an improved lampshade that would be flexibly decorative, but simple to manufacture, install and maintain. One proposed solution consists of the addition of removable and replaceable covers that can be washed or cleaned. A typical solution is to manufacture an easily replaceable fabric cover that is arranged over an existing lampshade (or a bare lampshade wire frame) to decorate and protect it. This design of replaceable cover offers the possibility to match a colour and pattern of the lampshade material with the specific style of the room in which the lampshade is being used.

The idea of alterable decorative lampshade covering has been greatly developed in the prior art. Aside from fabric covers used with standard lampshades disclosed for example in U.S. Pat. No. 5,746,506 to Dunbar and 5,211,474 to Leitner, there have been proposed many methods of fabrication of customizable lampshades using other materials. The Throckmortons in their U.S. Pat. No. 4,068,120 disclose a lampshade structure that provides for the adherence of specially designed panels to a polystyrene lampshade. A lampshade with coiled interchangeable shades has been disclosed in Chan's U.S. Pat. No. 6,000,817. This lampshade is made of a translucent sheet, arranged in a loop or coil which bulges outwardly to form a wall, which surrounds a lamp bulb assembly, can be of varying heights and shapes and is easily interchangeable. The frame assembly can be manufactured and sold as a modular kit, having vertical and horizontal parts, which can be of different form after the assemblage. The lampshade disclosed in U.S. Pat. No. 4,268,896 to Mann consists of a rigid support frame that supports two or more design panels formed as bowed sheets, achieving an inwardly-illuminated effect for the design, thus enabling a multiplicity of decorative sheet panels to be used as lampshade components with no assembly task except inserting them into support grooves, with no glue or other fastening means. This lampshade, however, is very difficult to manufacture. The frame of the lampshade is not flexible, so unless only two supports are used for a total of only two panels, it requires a large shipping container. Yet with only two support members, the sheet panels may very easily fall out, because only a small amount of friction holds them along their edges in the slots. In addition, the appearance of the resulting lampshade is limited to circular cylindrical configurations, as the support members are always vertically oriented.

A lamp is an important part of any interior decoration, and, as is obvious from the prior art, many individuals have been trying to find convenient methods of manufacturing a lampshade that would be aesthetic, inexpensive and readily adaptable to match the style of other pieces of furniture in the room. Ideally, a lampshade should be attractive and adaptable in as many design variations as possible within the limitations of the structure of the frame. Another consideration in designing a lampshade is its safety. The design must maintain a prudent distance between any flammable materials and a bulb, which is a source of heat, usually present when light is generated in useful intensities. It is usually desirable that the material of the lampshade be at least partially translucent so light can be diffused to the surrounding area. A lampshade should be easily removable from the lamp so that the light bulb can be changed from above, rather than having the user touch the lower, metallic, possibly electrified screw-base of a broken or burnt out bulb.

SUMMARY OF THE INVENTION

It is a primary object of the present invention to provide a novel lampshade structure and economical method of fabricating and assembling the same.

It is another object of the present invention to provide a frame for lampshade that is adapted to receive removable and replaceable decorative paper or plastic panels.

It is also an object of the present invention to provide a lampshade, which is customizable. The lampshade frames can be assembled to have different forms, depending upon the number of components used. Users can be provided with, or they can design and produce various replacement panels, in a multitude of patterns and colours and at little cost to renew, repair, or change the appearance of the lampshade.

It is a further object of the present invention to provide such lampshade in kit form, readily assembled by the user, that can be compactly packaged and shipped.

It is still another object of the present invention to provide a lampshade that can be easily lifted from the lamp, exposing the bulb and socket for cleaning or replacement.

In accordance with aspects of a preferred embodiment of the present invention, there is provided an improved lampshade that consists of a plurality of semi-rigid or rigid elongate slotted bars, cords linking all the bars and resilient panels snugly fitting between the bars, the side edges of the panels fitting between consecutive bars into facing slots extending longitudinally along selected sides of the bars. The bars are arranged in a truncated conical or cylindrical configuration, or can have triangular (if the bars are three in number) or rectangular (if the bars are four in number) horizontal cross-section. Instead of having a truncated overall shape, the lampshade may also have an overall pyramidal or conical shape if the bars are continued upwardly to meet at an apex. Each bar has two or more parallel holes bored completely through it with one hole at or near each end and slots running longitudinally along two sides of each bar beginning and ending at or near the holes mentioned above. The exact position of the slots depends upon the number of the bars and the dimensions of the panels that fit into the slots to form, with the bars, the completed lampshade. When there are a lot of bars forming, with other constituent elements to be described below, the frame for the lampshade, the elongate slots will be formed on opposed sides of the bars. When the bars are three or four in number, it may be more convenient to place the slots on two mutually perpendicular sides of each bar. In a preferred embodiment of the invention, the slots are placed on two opposite sides of each bar, precisely on those two sides on which the holes are visible. In each case, the exact position of the holes should be preferably adapted to the arrangement of the slots. Normally all of the bars for a given lampshade will be identical to one another.

The slots can also be formed as a series of several elongate longitudinally spaced recesses machined or otherwise formed in the sides of the bars. In this case, the shapes of the edges of the shading panels have to be adapted to the position and the length of the slots on the bars. Providing an interrupted series of slots instead of a single continuous slot would significantly complicate the manufacture of the lampshade, but may be convenient in some cases, for example when the bars are formed from hollow plastic or metal.

All bars are linked at one end thereof by a cord (this definition also includes any cable or wire) passing through a hole in one bar and then through the corresponding hole in each adjacent bar in turn until it returns to the position from which it started, describing a rough circle (in the case of a lampshade whose final shape is a cylinder or cone) or other contour that is coaxial with and perpendicular to the axis of a whole structure. The bars are similarly linked at the other end thereof; accordingly, at least two cords are required, each to connect one set of holes. The two free ends of each cord are preferably joined inside one hole so that the free ends are not visible. The overall length of the cord is fixed, thereby limiting the maximum combined distance between the bars at each end of the frame. Normally the bars will be equally spaced from one another along the length of the cord. Assuming a multiplicity of bars and upper and lower cords of different lengths, it can be seen that this design enables the formation of a truncated conical configuration of the lampshade.

The bars can be secured in specific positions on each cord by using adhesives or mechanical means such as crimped tubes. Tubes of malleable metal, slightly longer than the length of each hole, can be tightly inserted into the holes on each bar so that their ends protrude from the holes. Each tube can be further secured by a washer placed tightly over each protruding end, one face of each washer positioned closely to the adjacent side wall of the bar. The cord then passes through the tube and the bars are secured in specific position on the cord by crimping the projecting parts of the tubes onto the cord or by applying adhesives. When the tubes are crimped and deformed, the washers cannot slide off the tubes and thus are automatically secured in their position as well. If the panels are stiff enough to maintain the overall shape of the lampshade, the bars can be arranged in their preferred configuration on each cord by insertion of panels of specific selected form into the slots, without using any additional attaching means to secure the bars onto the cords.

In order to attach the lampshade to the lamp, a transverse notch is removed from the inner face of each bar at fixed distance from the hole on the upper end so as to form a transverse channel in the upper portion of each bar. A lampshade support element having an outer periphery of the required shape (i.e., triangular, rectangular, or an annulus of circular or other suitable shape) is fitted snugly into the set of channels. A cross member is secured to the peripheral portion of the support element and is provided centrally with a standard means for mounting the support on the lamp base. If the lampshade is to be of truncated conical shape, for example, the peripheral portion of the support may be a rigid circular ring. The rigidity of the ring also helps to maintain the specific preferred shape of the lampshade.

The bars might be fabricated from one specific material or a combination of various materials. In the preferred embodiment, the bars are made of lightweight wood, which helps to reduce the overall weight of the structure; other convenient materials are aluminium and plastic. If they are fabricated from metal or plastic, the bars may be hollow and may thus have void spaces at their ends. In such cases, a plug made to fit into each end of the bar can be provided to improve the overall look of the lampshade. The plug can serve exclusively a decorative purpose, or can serve to secure the cord in a specific position in the bar by clamping, pinching or distorting it, thus eliminating the need for other cord-affixing components.

Resilient panels, typically of trapezoidal or rectangular shape, are inserted into the slots in the bars and fit tightly between the bars. These shading panels are an important part of the whole structure, as they help hold the bars apart. The panels may be made of synthetic paper such as YUPO™, which is very suitable for this purpose, or of thin plastic sheets. By using such techniques as process colour printing, manufacturers will have the possibility to develop many variations of panels with different colours, patterns or graphic designs that they consider to be suitable in order to make the finished lampshade attractive to a wide customer base. The panels can also be changed seasonably, or at any occasion when it is convenient or desirable to modify the look of the lampshade.

The structure of the above-specified lampshade, which can be manufactured in kit form for ease of shipping and readily assembled by the user, is very flexible, resilient, customizable, resistant to damage, and facile to maintain. In exploring further the possibilities offered by the present design, the introduction of synthetic paper for this purpose will also enable individual users to design their own personalized lampshades.

BRIEF DESCRIPTION OF THE DRAWINGS

The invention, as exemplified by a preferred embodiment, is described with reference to the drawings in which:

FIG. 3 is a cross-section view of a representative solid bar of a type suitable for use in the lampshade shown in FIG. 1.

FIG. 4 is a perspective view of the top portion of a bar suitable for use in a lampshade structure that is an alternative to the structure of the lampshade shown in FIG. 1, showing one possible embodiment of bar assembly.

FIG. 5 is a perspective view of a top part of a bar showing another possible embodiment of bar assembly.

FIG. 6 is a perspective view of a top part of a bar showing still another possible embodiment of bar assembly.

FIG. 7 is a perspective view of a top part of a bar after crimping of the tube on its edges conforming to the particular choice of bar assembly illustrated in FIG. 1 and showing, in phantom, the internal structure of the bar.

FIG. 8 is a cross-section view of an example of an alternative embodiment of a bar for use in the lampshade structure according to the invention, the bar being of an extruded type.

FIG. 9 is a cross-section view of an example of another embodiment of extruded bar of another type alternative to that of FIG. 8.

FIG. 10 is a partially exploded perspective view of an embodiment of a bar using one of the bars as shown in FIGS. 8 or 9 with a mating plug that will be inserted into the bar and that includes a cord-engaging recess that will help to retain the cord in place.

FIG. 11 is a partially exploded perspective view of another embodiment of a bar of the type shown in FIGS. 8 or 9 with a simple mating plug that does not engage the cord.

FIG. 12 is a cross-section view of another possible embodiment of a bar for use in a lampshade according to the present invention.

FIG. 13 is a perspective view of an embodiment of a bar using the type of bar shown in FIG. 12 with an inserted simple mating plug.

FIG. 14 is a cross-section view of still another possible embodiment of a fabricated bar for use in a lampshade according to the present invention.

FIG. 15 is a cross-section view of yet another embodiment of a fabricated bar for use in a lampshade according to the present invention. This figure shows how bars could be fabricated using metal, plastic or other materials.

DETAILED DESCRIPTION OF THE PREFERRED EMBODIMENT

Figure 1:
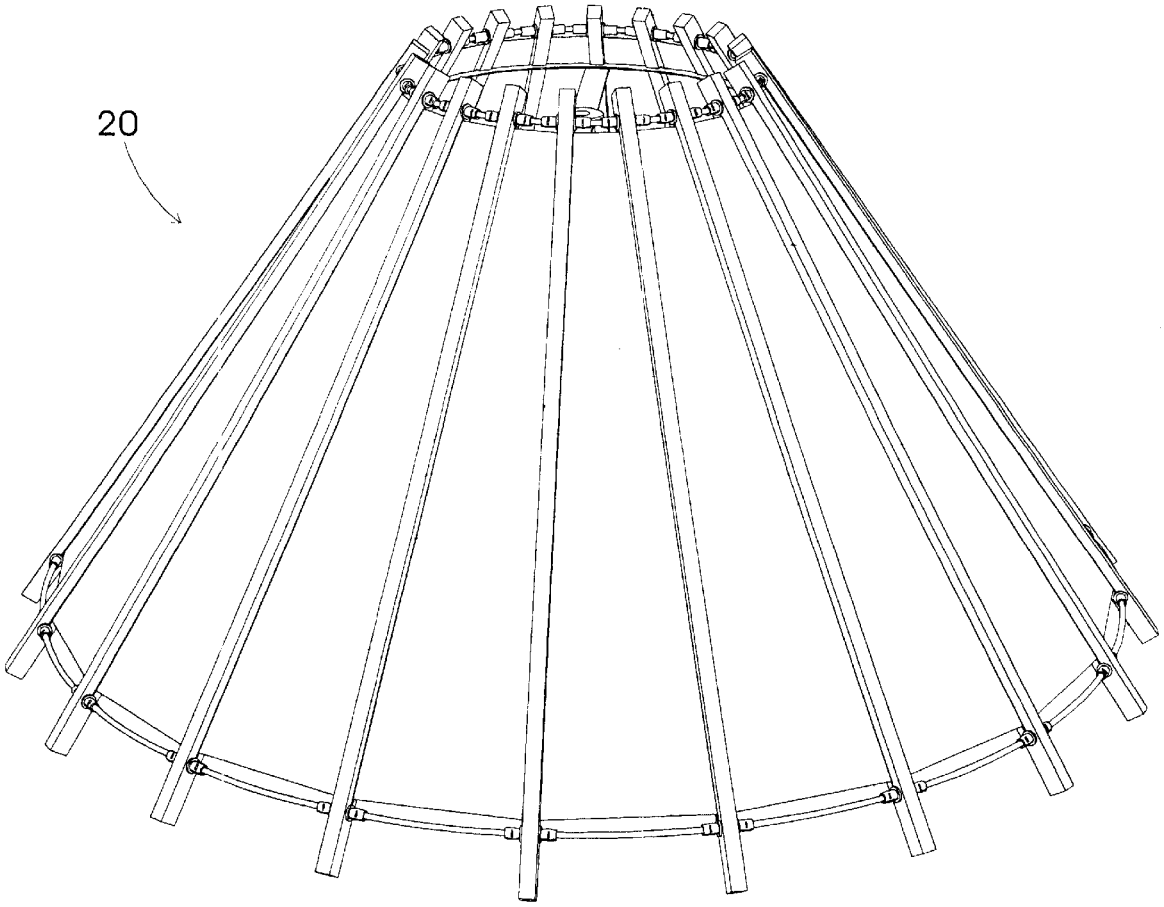
FIG. 1 is a perspective view of one preferred embodiment of a lampshade according to the present invention.
Figure 2:
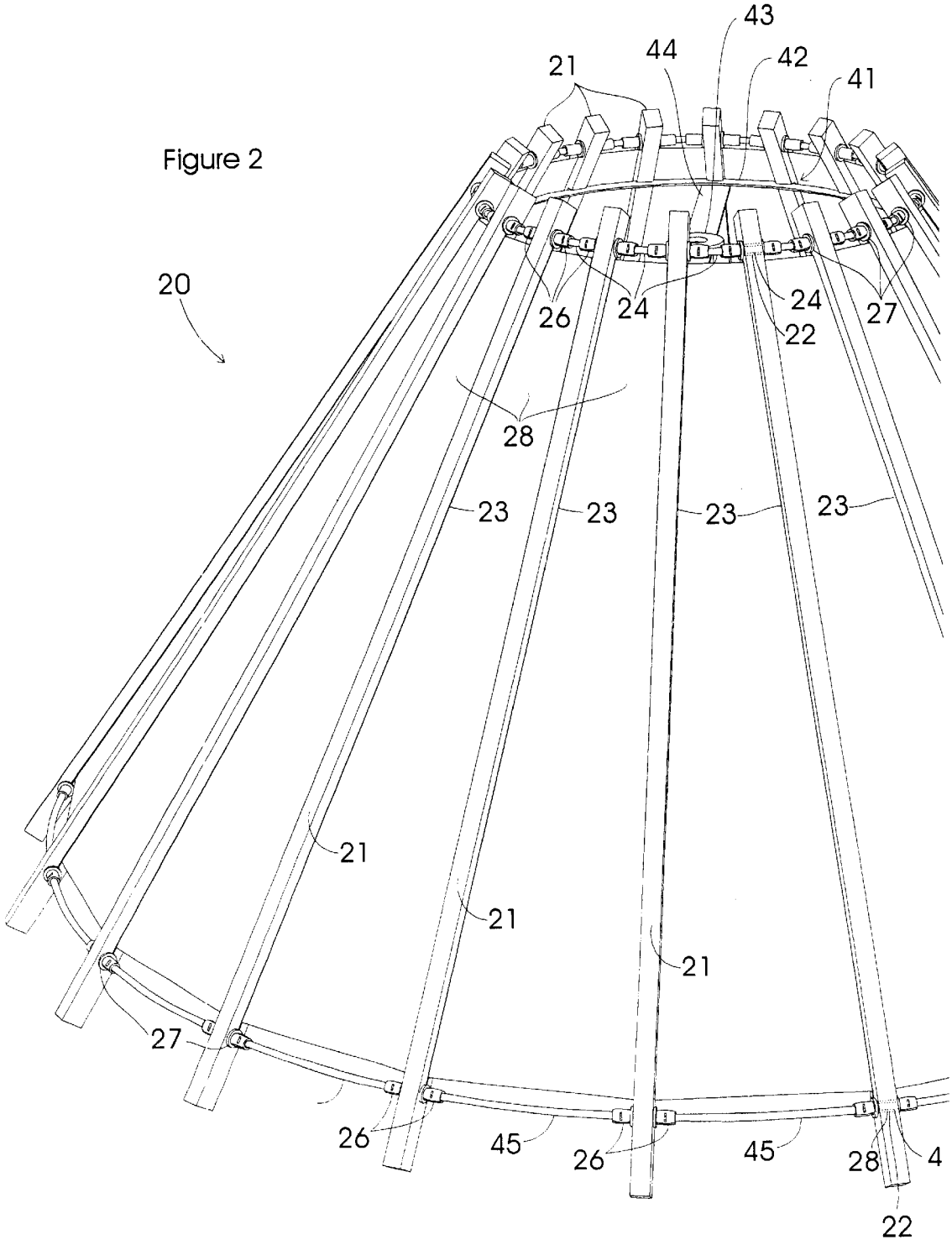
FIG. 2 is a perspective view of a portion of the lampshade of FIG. 1.

Referring now to the drawings, there is shown in FIGS. 1 and 2 a preferred embodiment of a lampshade 20 made in accordance with the present invention. The lampshade 20 is composed of a number of rigid or semi-rigid bars 21 that are in a preferred embodiment arranged in a truncated conical configuration, each having upper and lower holes 22 (FIGS. 2 and 4) bored completely therethrough with one hole at or near each end. As can be seen on all figures, two slots 23 run in the preferred embodiment longitudinally along opposite sides of each bar beginning and ending at or near the holes 22 described above. An upper cord 24 passes through a hole 22 in one bar 21 and then through the corresponding hole 22 in each adjacent bar 21 in turn until the cord 24 returns to the position from which the cord 24 started describing a rough circle coaxial with and perpendicular to the axis of the frustoconical shape of the lampshade structure. In the preferred embodiment, two distinct cords are required, an upper cord 24 for connecting the upper set of holes 22 in the bars 21, and a lower cord 45 for connecting the lower set of holes 22 in the bars 21. (If there are more than two sets of holes, there should be one cord for connecting each set of holes. If the height of the lampshade 20 is not too great and the bars 21 are not too flimsy, two sets of holes 22, an upper set and a lower set, should suffice, absent a decorative reason to add a further set of holes 22.) Each cord 24, 45, as the case may be, is joined end to end so that its overall length is fixed thereby limiting the maximum combined distance between the entire set of bars 21. Trapezoidal or rectangular resilient panels 28 shaped to fit snugly between the bars 21 are placed with their long, opposed side edges into the slots 23 in said bars 21.

In one embodiment of the invention, the bars 21 are composed of lengths of a semi-rigid or rigid material with solid cross-sections; see e.g. FIG. 3. A structurally convenient and aesthetically pleasing practical material of which to make a bar 21 of the type shown in FIG. 3 is wood. In this embodiment, the slots 23 are cut into the opposite sides of the bars 21, as shown in FIG. 1 and other figures. The cords 24 and 45 may be connected to the bars 21 in essentially the same manner; for convenience, only the connection of the cord 24 will be described. The cord 24 can pass directly through the holes 22 in the wood as shown in FIG. 4, or the cord 24 can pass through tubing sections 26 inserted into each hole as shown in FIG. 5. The tubes 26 fit tightly into the holes 22 and are slightly longer, so the ends of each tube 26 protrude from the corresponding hole 22 to a length sufficient to permit the tube ends to be crimped or to apply adhesive. The tubes 26 provide for a more durable and secure junction between the cords 24 and the wood of the bars 21. The cord 24 can be secured in a precise position in the tubes 26 by adhesives (FIGS. 4, 5, 6) or by crimping (FIG. 7) the extruding portions of the tubing onto the cord 24. By the crimping of the tubes 26 onto the cord 24, each tubing section 26 is secured in the correct position in the hole 22, since the distortion of the protruding part of the tube 26 prohibits the tube from passing in either direction through the hole 22. The preferred position of the tubing sections 26 in the holes 22 can be further established by the inclusion of washers 27 (FIG. 6). At least one washer 27 is placed on each protruding end of each tubing section 26 against the side wall of the bar as shown in FIG. 6. The washers 27 are also secured in position by crimping of the tubes 26 on the cord 24 as described above and as seen in FIG. 7.

In another possible embodiment of the invention, the bars 21 are made of metal or plastic extrusions with the longitudinal slots intrinsic to their profile as shown in FIGS. 8 and 9. These extrusion bars 21 are drilled to receive the cord 24. A clamping plug 30 that will be inserted into the hollow spaces on both ends of the bar can be provided for aesthetic reasons and to help maintain the cord 22 in preferred position. FIG. 10 represents one possible embodiment of the plug 30, which, after being inserted into the bar 21, applies pressure on the cord 24 and secures the cord 24 in a preferred position in the bar. To this end, the lower portion of the plug 30 is formed as set of depending legs 48 having therebetween a slot 46 having an inset pair of opposed semicylindrical recesses 47 that receive therebetween the cord 24; if the plug 30 is formed slightly oversize relative to the aperture at the top of the hollow bar 21, when the plug 30 is pressed into the top of the bar 21, the cord 24 will be compressed within the two semicylindrical recesses in the interior of the plug 30 between opposed sets of legs 48 in a tight friction grip. In this case, no other means (such as tubes with washers) are needed to secure the cord 24 in its correct position. Equally, when cord securing means, such as the crimped tube 26 and the washer 27, are used with the hollow bars 21, the clamping plug 30 is not needed and a simple cosmetic plug 31 may be used instead (FIG. 11).

The bars 21 may be fabricated from lengths of various materials, i.e., wood, metal, plastic, or of any combination of different materials in various cross-sectional configurations as shown in FIGS. 12, 13, 14, and 15. The choice of a material or a combination of materials is an important feature of the design and can significantly affect the eventual appearance of the lampshade. The choice of material is arbitrary as long as the resulting bar 21 is sufficiently rigid to hold its shape, carries two longitudinal slots 23 running down its sides to receive the elongate edges of the panels 28, and has at least two holes 22 through which the cords 24 may pass and be secured in a specific position. Note, however, that alternatives to the foregoing design elements are possible within the scope of the invention. For example , instead of holes 22, the bars 21 could be provided with attached eyes (not illustrated) through which the cords 24, 45 pass. Rigid annular material could be substituted for a cord 24 or 45. Panels 28 could be provided with tabs having bar-engagement elements, etc. However, the structure illustrated and described herein is considered to be preferred for reasons of convenience, economy and aesthetics.

As mentioned above, in the preferred embodiments illustrated, trapezoidal or rectangular resilient panels 28 shaped to fit snugly between the bars are placed with their long, opposing edges into the slots 23 in the bars 21. The panels 28 may help to hold the individual bars 21 apart and maintain the overall shape of the lampshade 20. The panels 28 may be fabricated from the flexible synthetic paper such as YUPO™ or from a thin sheet of resilient plastic material. The great advantage of these materials is that they can be covered with the print or paint of any colour, pattern, apparent texture or any design suitable to attract a specific group of customers. To change individual panels of the lampshade is very simple and inexpensive—they can be changed within the specific frame to follow the alteration of seasons, the changes in interiors, occasions, and can also be entirely personalized and handcrafted as well. Although the structure of the lampshade 20 is overall sufficiently rigid to maintain its shape, yet the structure is somewhat flexible and resilient, permitting the user of the lampshade to remove and replace individual panels 28 without disassembling the lampshade 20.

A means of attaching the lampshade 20 to a lamp (not shown) is illustrated in FIG. 2. A transverse notch 41, illustrated in FIGS. 7, 10, 11 and 13, is formed on the inner face of each bar at a fixed distance from the upper hole 22. A lampshade support element 42, in a preferred embodiment having the form of a circular annulus, is made to fit snugly into the array of channels formed when the bars 21 are arranged and secured in their frustoconical position on the cords 24, 45. An annular mounting plate 43 is secured in the proper position by radial spokes 44 together serving as a cross-piece fixed to the annular element 42 which thereby attaches the annular mounting plate 43 to the toroidal annular lampshade support element 42. In other embodiments of the present invention of a lampshade 20, the form of the lampshade support element 42 depends on the configuration of the bars 21.

The scope of the invention is not to be limited by the specific details described, but is to be given the full scope established by the appended claims. As previously mentioned, as used in this description and in the appended claims, some words should be given an expanded meaning consistent with their purpose in the context. For example, the word "cord" includes cable, cord, or wire; the term "bar" includes various elongate structural elements that may be solid or hollow, etc.

What is claimed is:

1. A lampshade, comprising in combination:

a. a plurality of semi-rigid or rigid bars; each bar having a pair of mutually spaced longitudinal slots and at least two parallel holes drilled completely through each said bar in the vicinity of each of its ends;

b. at least two cords linking said bars, one said cord passing through an upper set of said holes and another said cord passing through a lower set of said holes;

c. thin resilient panels shaped to fit between consecutive bars with their side edges fitting into said slots;

each said cord interconnecting all of said bars by passing through each hole in one set of corresponding holes on all said bars, two ends of each cord joined end to end with the joined ends secured inside one of said holes to form with the bars a lampshade frame, the interconnected upper ends of the bars forming an array that is coaxial with the array formed by the interconnected lower ends of the bars;

all said components arranged in a selected specific geometric configuration that depends on the number of the bars and the distances between consecutive bars.

2. The combination of claim 1 wherein said bars are secured in distinct positions along the cords by means of adhesives.

3. The combination of claim 1 wherein said bars are secured in distinct positions on the cords by mechanical means.

4. The combination of claim 3 wherein said mechanical means comprises tubes each longer than a said hole through a said bar, each said tube fitting tightly into a mating said hole on an associated said bar and slightly protruding from the ends of such hole.

5. The combination of claim 4 wherein each said cord passes through the tubes inserted into corresponding holes on said bars; said tubes being crimped to said cord in order to secure the cord in its specific position inside said bar.

6. The combination of claim 5 additionally comprising washers mating with the tubes, each said washer placed snugly over an associated protruding end of an associated said tube with one face positioned tightly against an adjacent wall of the bar.

7. The combination of claim 6 wherein the tubes are crimped to said cord in order to secure the cord in its specific position inside said bar.

8. The combination of claim 1 wherein said bars are fabricated of wood.

9. The combination of claim 1 wherein said bars are composed of metal or plastic extrusions having said slots intrinsic to their profile.

10. The combination of claim 9 wherein the ends of said bars are each formed to provide one or more voids extending longitudinally from the associated end into the bars.

11. The combination of claim 10 additionally comprising plugs mating with and for insertion into the voids at the ends of each bar; each plug clamping, pinching, or distorting the cord inside the bar to secure it in a distinct position in the bar.

12. The combination of claim 10 additionally comprising short, decorative plugs mating with and for insertion into the voids at the ends of each bar, said bars being secured in a distinct position on the cords by adhesive or mechanical means.

13. The combination of claim 1, additionally comprising means for attaching the lampshade to a lampbase.

14. The combination of claim 13 wherein the means of attaching the lampshade to the lamp comprises a series of transverse channels on the inner sides of the bars at a fixed distance from the upper holes on the bars; a lampshade support element fitted snugly into the array of channels formed when the bars are arranged and secured in a frustoconical array on the cords; the peripheral portion of said lampshade support element being secured to a cross member that is provided centrally with a standard means for mounting the support on the lamp base.

15. The combination of claim 1 wherein the structural array of bars and the selected specific geometric configuration of the lampshade have generally circular symmetry about a vertical axis.

16. A lampshade comprising:

a. A plurality of semi-rigid bars arranged in a frustoconical configuration, each said bar having two holes bored completely through the bar, one hole at or near each end of such bar, said holes being generally parallel to one another; each said bar also having a pair of mutually spaced longitudinal slots running along opposite sides of such bar, the slots beginning and ending at or near said holes, and each said bar having a transverse channel at a short distance from the upper end of the bar and located on the inner face of the bar;

b. a plurality of tubes of malleable metal each inserted tightly into a corresponding one of said holes so that a short end piece of such tube protrudes from each end of said hole; said tubes being further secured in the holes by washers that are placed snugly over the protruding ends of the tubes and are positioned to have one face against an adjacent face of the bar;

c. two cords, each of which connects said bars by passing through one complete set of holes through inserted tubes describing an approximate circle coaxial with and perpendicular to the axis of the conical aspect of the structure, each said cord being joined end to end within one of the tubes so that the joinder is not visible and so that the spaces between the bars are fixed; the protruding ends of said tubes crimped onto the perimeter of the associated cord with sufficient force to secure the cord inside of the malleable metal tube;

d. a toroidal annulus made to fit snugly into the set of transverse channels; the toroidal annulus having a cross member with means for mounting to the lamp;

e. generally trapezoidal panels made of translucent synthetic paper or plastic that are shaped to fit snugly between the bars and are placed with their long, opposing edges in the slots in the bars.

17. A lampshade, comprising in combination:

a. a set of bars forming a structural array; the structural array having an axis such that interconnected upper ends of said bars form an array that is coaxial with the array formed by the interconnected lower ends of the bars;

b. cords interconnecting all of said bars;

c. thin resilient panels shaped to fit between consecutive bars, at least some of which panels are translucent;
the configuration of the structural array of said set of bars being determined by the number of bars, the lengths of said cords, and the shapes and dimensions of the panels therebetween;

d. said bars being composed of metal or plastic extrusions having said slots intrinsic to their profile;

e. the ends of said bars being each formed to provide one or more voids extending longitudinally from the associated end into the bars;

f. plugs mating with and for insertion into the voids at the ends of each bar; each plug clamping, pinching, or distorting the cord inside the bar to secure it in a distinct position in the bar.

18. A lampshade, comprising in combination:

a. a set of bars forming a structural array; the structural array having an axis such that interconnected upper ends of said bars form an array that is coaxial with the array formed by the interconnected lower ends of the bars;

b. cords interconnecting all of said bars;

c. thin resilient panels shaped to fit between consecutive bars, at least some of which panels are translucent;
the configuration of the structural array of said set of bars being determined by the number of bars, the lengths of said cords, and the shapes and dimensions of the panels therebetween;

d. said bars being composed of metal or plastic extrusions having said slots intrinsic to their profile;

e. the ends of said bars being each formed to provide one or more voids extending longitudinally from the associated end into the bars;

f. short, decorative plugs mating with and for insertion into the voids at the ends of each bar, said bars being secured in a distinct position on the cords by adhesive or mechanical means.

19. A lampshade, comprising in combination:

a. a set of bars forming a structural array; the structural array having an axis such that interconnected upper ends of said bars form an array that is coaxial with the array formed by the interconnected lower ends of the bars;

b. cords interconnecting all of said bars;

c. thin resilient panels shaped to fit between consecutive bars, at least some of which panels are translucent;
the configuration of the structural array of said set of bars being determined by the number of bars, the lengths of said cords, and the shapes and dimensions of the panels therebetween;

e. means for attaching the lampshade to a lampbase, comprising a series of transverse notches on the inner sides of the bars at a fixed distance from the upper ends of the bars;

a lampshade support element having a peripheral portion fitted snugly into the array of notches formed when the bars are arranged and-secured in a frustoconical array on the cords; the peripheral portion of said lampshade support element being secured to a cross-member that is provided centrally with a standard means for mounting the support on the lamp base.

20. A set of components for making lampshades, sold together as a compact kit, comprising:

a. a plurality of semi-rigid or rigid bars, each having an upper end and a lower end, for forming a structural array;

b. at least two cords for linking all of said bars;

c. thin resilient panels shaped to be fitted between consecutive bars and at least some of which are made of translucent syntetic paper or plastic;
all said components being for assembly to form a lampshade having a selected specific geometric configuration that depends on the number of the bars and the distances between consecutive bars;

d. means for attaching the lampshade to a lampbase, comprising a series of transverse notches on the inner sides of the bars at a fixed distance from the upper ends of the bars; a lampshade support element having a peripheral portion for fitting snugly into the array of notches formed after the bars are arranged and secured in their frustoconical position on the cords; the peripheral portion of said lampshade support element for being secured to a cross member that is provided centrally with a standard means for mounting the support on the lamp base.

21. A set of components for making lampshades, sold together as a compact kit, comprising in combination:

a. a plurality-of semi-rigid or rigid bars; each bar having a pair of mutually spaced longitudinal slots and at least two parallel holes, an upper hole and a lower hole, drilled completely through each said bar in the vicinity of each of its ends;

b. at least two cords for linking said bars, one said cord for passing through a set of said upper holes and another said cord for passing through a set of said lower holes;

c. thin resilient panels shaped to fit between consecutive bars with their side edges fitting into said slots;

each said cord for interconnecting all of said bars by passing through each upper hole or each lower hole on all said bars, two ends of each cord for joining end to end with the joined ends secured inside one of said holes to form with the bars a lampshade frame when the components have been assembled, the interconnected Upper ends of the bars forming an array that is coaxial with the formed by the interconnected lower ends of the bars when the components have been assembled;

all said components for arranging in a selected specific geometric configuration that depends on the number of the bars and the distances between consecutive bars.

* * * * *